US005692936A

United States Patent [19]

Yamaguchi et al.

[11] Patent Number: 5,692,936

[45] Date of Patent: Dec. 2, 1997

[54] MOISTURE-PERMEABLE WATERPROOF FABRIC AND PROCESS FOR PRODUCING THE SAME

[75] Inventors: Munehide Yamaguchi; Hideki Chatani, both of Nomi-gun; Shunichi Hayashi, Nagoya; Yukihiro Sakaguchi, Nagoya; Satoru Kondo, Nagoya, all of Japan

[73] Assignees: Komatsu Seiven Co., Ltd., Ishikawa; Mitsubishi Jokogyo Kabushiki Kaisha, Tokyo, both of Japan

[21] Appl. No.: 636,129

[22] Filed: Apr. 22, 1996

Related U.S. Application Data

[63] Continuation of Ser. No. 185,853, filed as PCT/JP93/00827, Jun. 18, 1993, abandoned.

[30] Foreign Application Priority Data

Jun. 19, 1992 [JP] Japan ..... 4-160978
Aug. 3, 1992 [JP] Japan ..... 4-206720

[51] Int. Cl.[6] ..... B32B 5/24; B32B 31/24; B32B 33/00; D06M 15/568

[52] U.S. Cl. ..... 442/63; 156/230; 156/238; 427/336; 427/341; 427/342; 428/315.9; 428/423.1; 428/425.1

[58] Field of Search ..... 156/230, 238; 427/336, 341, 342; 428/315.5, 315.9, 423.1, 425.1; 442/63

[56] References Cited

FOREIGN PATENT DOCUMENTS

| | | |
|---|---|---|
| 2369815 | 6/1978 | France . |
| 2431846 | 1/1976 | Germany . |
| 59-158252 | 9/1984 | Japan . |
| 59-199869 | 11/1984 | Japan . |
| 61-245376 | 10/1988 | Japan . |
| 2-3467 | 1/1990 | Japan . |
| 2-068366 | 3/1990 | Japan . |
| 2-68366 | 7/1990 | Japan . |
| 3-182571 | 8/1991 | Japan . |
| 3-294582 | 12/1991 | Japan . |
| 4-370276 | 12/1992 | Japan . |

*Primary Examiner*—James C. Cannon
*Attorney, Agent, or Firm*—Burns, Doane, Swecker & Mathis, L.L.P.

[57] ABSTRACT

A moisture-permeable waterproof fabric comprising a textile fabric and, provided on at least one surface of said textile fabric, a resin film comprising a polyurethane resin produced by reacting an isocyanate with a polyol and a chain extender and having a glass transition temperature in the range of from −20° to 20° C. and an ethylene oxide unit content of at least 7.0 mol/kg. The moisture-permeable waterproof fabric is produced by coating at least one surface of a textile fabric with a solution of a resin in a polar organic solvent, the resin comprising a polyurethane resin, and subjecting the coating to wet solidification in a coagulation bath to form a film, or coating a release paper with a solution of a resin in a polar organic solvent, the resin comprising a polyurethane resin, to form a resin film and adhering the resin film on at least one surface of a textile fabric.

16 Claims, No Drawings

MOISTURE-PERMEABLE WATERPROOF FABRIC AND PROCESS FOR PRODUCING THE SAME

This application is a continuation of application Ser. No. 08/185,853, filed as PCT/JP93/00827 Jun. 18, 993, now abandoned.

TECHNICAL FIELD

The present invention relates to a moisture-permeable waterproof fabric and a process for producing the same. More particularly, the present invention is concerned with a comfortable moisture-permeable waterproof fabric, which can control the moisture permeability and heat retaining property in correspondence with bodily sensation regarding warmth and coldness, and a process for producing the same.

BACKGROUND ART

Conventional techniques for producing finished fabrics having both moisture-permeable and waterproofing properties were aimed principally at enhancing the moisture permeability for preventing humidity during active motion while maintaining the waterproof property. However, waterproof finished fabrics having a high moisture permeability provided by the conventional techniques have poor heat retaining property due to their high moisture permeability, so that a person feels cold when the service temperature is low, that is, when the body is not yet sufficiently heated before exercise. On the other hand, in waterproof finished fabrics having a low moisture permeability, since the moisture permeability is low, a person feels humid and hot when the service temperature is high, that is, when the body is in a sufficiently heated state and sweats profusely during or after exercise. Therefore, the finished fabrics produced by the conventional production techniques do not have such a function as to provide real comfort, that is, a function that when the service temperature is low, they exhibit a high heat retaining property and render the body warm while when the service temperature is high, they are less likely to retain sweat and can provide coolness.

DISCLOSURE OF THE INVENTION

An object of the present invention is to provide a moisture-permeable waterproof fabric having real comfortability, characterized by having a high heat retaining property when the service temperature is low while enjoying a high water-vapor permeability to provide coolness when the service temperature is high, and a process for producing the same.

In order to attain the above-described object, the present invention provides a moisture-permeable waterproof fabric comprising a textile fabric and, provided on at least one surface of said textile fabric, a resin film comprising a polyurethane resin produced by reacting an isocyanate with a polyol and a chain extender and having a glass transition temperature in the range of from −20° to 20° C. and an ethylene oxide unit content of at least 7.0 mol/kg.

Further, the present invention provides a process for producing a moisture-permeable waterproof fabric, comprising the steps of: coating at least one surface of a textile fabric with a solution of a resin in a polar organic solvent, said resin comprising a polyurethane resin produced by reacting an isocyanate with a polyol and a chain extender and having a glass transition temperature in the range of from −20° to 20° C. and an ethylene oxide unit content of at least 7.0 mol/kg, and subjecting the coating to wet solidification in a coagulation bath to form a film, or coating a release paper with the above-described solution of the resin in a volatile organic solvent to form a film and adhering the film on at least one surface of a textile fabric.

BEST MODE FOR CARRYING OUT THE INVENTION

The textile fabric useful for the present invention may comprise a chemical fiber, such as a polyester, polyamide, acrylic or rayon fiber, a natural fiber, such as cotton or wool, or a mixture thereof. They may be in the form of any of a woven fabric, a knit and a nonwoven fabric.

In the polyurethane resin used in the present invention and produced by reacting an isocyanate with a polyol and a chain extender, a component having a rigid structure serving to suppress the molecular motion is used for constituting the polyurethane resin to bring the glass transition temperature of the polyurethane resin to the range of from −20° to 20° C., thereby rendering the moisture permeability of the fabric highly dependent upon the temperature.

In the production of the polyurethane resin useful for the present invention, known isocyanates commonly used in polyurethane may be used as the isocyanate component. Preferred examples thereof include 4,4'-diphenylmethane diisocyanate (MDI), hydrogenated MDI, isophorone diisocyanate, 1,3-xylene diisocyanate, 2,4-tolylene diisocyanate and m-phenylene diisocyanate. They may be used alone or in the form of a mixture of two or more of them. MDI and hydrogenated MDI are still preferred from the viewpoint of rigidity of the molecular structure.

The chain extender may also be one known in the art. Preferred examples thereof include ethylene glycol, propylene glycol, 1,4-butanediol, 1,6-hexanediol, ethylenediamine, trimethylenediamine, isophoronediamine and water. They may be used alone or in the form of a mixture of two or more of them. Ethylene glycol, propylene glycol and water are particularly preferred from the viewpoint of rigidity of the molecular structure.

The polyol component may be one known in the art, and examples thereof include high-molecular weight diols, such as polyethylene glycol which is a product of addition homopolymerization of ethylene oxide, an ethylene oxide adduct of tetrahydrofuran which is a copolymer of ethylene oxide with another compound, an ethylene oxide adduct of bisphenol A, a condensate of adipic acid with ethylene oxide and an ethylene oxide adduct of polybutylene glycol adipate diol or polypropylene glycol adipate diol, and high-molecular weight diols not containing ethylene oxide, such as polytetramethylene glycol, polypropylene ether glycol, poly-ε-caprolactone glycol, polybutyrolactone glycol, polypropylene glycol adipate diol and polybutylene glycol adipate diol. They may be used alone or in the form of a mixture of two or more of them.

The polyol preferably has a molecular weight in the range of from 500 to 3,000. When the molecular weight is less than 500, the elastomeric performance of the resultant polyurethane resin is unsatisfactory, which results in poor durability during use. On the other hand, when the molecular weight is more than 3,000, conditions for synthesis are limited, which leads to a problem that when a film is formed from the resultant polyurethane resin, the film is opaque or exhibits a drawback such as fish eyes.

In the present invention, it is particularly preferred to use as the polyol a mixture comprising polyethylene glycol and polytetramethylene glycol or a mixture comprising polyethylene glycol and an ester of ethylene oxide with adipic acid, the polyols having a molecular weight in the range of from 500 to 3,000.

In the present invention, the fraction of the ethylene oxide in the polyurethane resin obtained by formulating the polyol, isocyanate and chain extender is held at 7.0 mol/kg or more.

The polyurethane resin used in the present invention is produced by a one-shot process or a prepolymer process in the absence (bulk polymerization) or presence (solution polymerization) of a solvent.

In the present invention, the above-described polyurethane resin my be used in the form of a mixture with other urethane resins. Examples of the other urethane resins include conventional urethane resins having a glass transition temperature of −20° C. or below, such as an ether urethane resin, an ester urethane resin, a polycarbonate urethane resin, a urethane resin modified with an amino acid and a urethane resin modified with fluorine.

In the products obtained from the fabric of the present invention, particularly articles of clothing, the ratio of the water vapor permeability at a high temperature to the water vapor permeability at a low temperature is preferably 1.4 or more from the viewpoint of ensuring the comfortability derived from the release from a sweaty feeling in a high-temperature and high-humidity environment and ensuring the comfortability derived from warmth in a low-temperature environment. The term "water vapor permeability ($g/m^2$.24 hr-mmHg)" used herein is intended to mean a numeric value obtained by dividing the moisture permeability ($g/m^2$.24 hr) at the measuring temperature by the partial pressure of water vapor (mmHg). Further, the expression "at a low temperature" is intended to mean that the temperature within clothes is in the range of from 0° to 20° C., and the expression "at a high temperature" is intended to mean that the temperature within clothes is in the range of from 20° to 50° C. Conventional moisture-permeable waterproof fabrics having a high moisture permeability have a constant high water vapor permeability ratio, so that at a high temperature they positively release water vapor outside the clothes and, at the same time, the latent heat of water vapor is released outside the clothes also at a low temperature, which easily offers a good comfortability. Since, however, the water vapor permeability is nigh also at a low temperature, the latent heat of water vapor is released outside the clothes, so that the heat retaining property is poor. On the other hand, conventional moisture-permeable waterproof fabrics having a low moisture permeability have a constant low water vapor permeability. Therefore, at a low temperature the water vapor is not significantly released outside the clothes and accumulates as latent heat within the clothes to provide a heat retaining property, whereas at a high temperature the clothes are likely to cause a sweaty or sticky feeling due to the low moisture permeability.

The higher the water vapor permeability at a high temperature, the lower the water vapor permeability at a low temperature and the higher the water vapor permeability ratio, the larger the temperature dependence of the moisture permeability of the moisture-permeable waterproof fabric, that is, the higher the tendency that at a high temperature the water vapor is positively released to prevent the inside of the clothes from becoming stuffy while at a low temperature the permeation of water vapor is inhibited to exhibit a heat retaining property.

In the present invention, the moisture permeability ($g/m^2$.24 hr) was measured according to a method specified in JIS L 1099 A-1. In this connection, conditions of a temperature of 5° C. and a relative humidity of 90% were adopted as the low-temperature environment used in the measurement, and conditions of a temperature of 40° C. and a relative humidity of 90% were adopted as the high-temperature environment used in the measurement.

Specific temperature and humidity in the high-temperature environment and the low temperature environment are not particularly limited. In this case, the temperature range and humidity range within clothes to be controlled my be determined depending upon applications, and the temperature and humidity in each of the high-temperature environment and the low-temperature environment may be determined based on the ranges. Then, selection is effected in such a manner that the ratio of the water vapor permeability at a high temperature to the water vapor permeability at a low temperature becomes high.

In the moisture-permeable waterproof fabric of the present invention, the moisture permeability in a high-temperature environment, i.e., at a temperature of 40° C. and a relative humidity of 90%, is preferably 8,000 $g/m^2$.24 hr or more, the moisture permeability in a low-temperature environment, i.e., at a temperature of 5° C. and a relative humidity of 90%, is preferably less than 1,000 $g/m^2$.24 hr or more, and the water pressure resistance is preferably 1,000 $mmH_2O$ or more.

The temperature at which water vapor is positively released and the temperature at which the heat retaining property is exhibited may be regulated by taking advantage of the glass transition temperature of the polyurethane resin depending upon the applications. The glass transition temperature of the polyurethane resin used in the present invention is in the range of from −20° to 20° C. from the viewpoint of the comfort of persons during usual work and exercise.

The moisture-permeable waterproof fabric of the present invention having the above-described constitution exhibits excellent moisture permeability in a high-temperature and high-humidity environment and reduces its moisture permeability in a low-temperature environment to exhibit an excellent heat-retaining property, which enables the temperature and humidity within products to be positively controlled.

The process for producing the moisture-permeable waterproof fabric of the present invention will now be described.

In the production of the moisture-permeable waterproof fabric by the wet process, for example, a polar organic solvent solution containing the above-described polyurethane resin is coated on at least one surface of a textile fabric preferably at a coverage of 3 to 50 $g/m^2$ to form a coating which is subjected to solidification and removal of the solvent and then dried. In this case, the coverage of the polyurethane resin is preferably in the range of from 3 to 10 $g/m^2$ after drying from the viewpoint of keeping the hand good. In applications where importance is given to the water pressure resistance, a polyurethane resin film is further formed by wet coagulation or dry process on the film formed by the above-described method. It is preferred to select the polar organic solvent used as the solvent for the polyurethane resin mainly from water-soluble polar organic solvents, such as dimethylformamide (hereinafter referred to as "DMF"), dimethylacetamide and N-methylpyrrolidone, from the viewpoint of solubility of the resin in the solvent and ease of removing the solvent. Further, it is also possible to add isocyanate crosslinking agents, surfactants, etc. to the resin solution. The isocyanate crosslinking agents serve to form a crosslinked structure in the film by the heat treatment after the formation of the film, which contributes to an improvement in strength and durability of the film.

The solidification and removal of the solvent may be effected by the conventional wet solidification method. An aqueous solution of the above-described solvent and water are preferably used as the coagulation bath. The solidification temperature is preferably in the range of from 5° to 50° C. from the viewpoint of regulating the diameter of pores formed in the resin film to a suitable range. Water is preferably used for removing the solvent. The temperature at which the solvent is removed is preferably in the range of from 10° to 80° C. The fabric is then dried by the conventional method. In this case, the drying temperature is preferably in the range of from 60° to 140° C. Further, a water repellency treatment may be effected according to need after drying for the purpose of imparting durable water repellency to the fabric. In the water repellency treatment, use may be made of known water repellents. Further, in order to improve the quality of the fabric product, it is preferred to further subject the fabric to finish setting. The fabric may be subjected to a water repellency treatment or a calendering treatment before it is coated with the resin.

The resin film formed by the wet process easily becomes porous to provide a moisture-permeable waterproof fabric having a good moisture permeability.

In the production of the moisture-permeable waterproof fabric by the dry process, for example, a volatile organic solvent solution containing the above-described polyurethane resin is coated on a release paper preferably at a coverage of 50 to 200 g/m$^2$ to form a resin film. Then, an adhesive resin is applied onto the resin film and, if necessary, dried at 40° to 150° C. It is then laminated to at least one surface of a textile fabric, and the release paper is peeled off. The coverage of the polyurethane resin after drying is preferably in the range of from 10 to 50 g/m$^2$, and preferred examples of the volatile solvent include toluene, methyl ethyl ketone, isopropyl alcohol and dimethylformamide. Ultraviolet absorbers, antioxidants, foaming agents, etc. may be added to the resin solution. In the dry process, both a porous resin film and a nonporous resin film can be produced. Further, isocyanate crosslinking agents, surfactants, etc. may also be added to the resin solution. The isocyanate crosslinking agents serve to form a crosslinked structure in the film by the heat treatment after the formation of the film, which contributes to an improvement in strength and durability of the film.

Further, a resin film may be applied by the dry process according to the present invention onto the surface of a resin film of a moisture-permeable waterproof fabric prepared from a conventional polyurethane resin. The waterproof fabric prepared by this method has a water pressure resistance of 10,000 mmH$_2$O or more.

In the moisture-permeable waterproof fabric according to the present invention, the moisture permeability depends upon the temperature. Specifically, when the service temperature is low, the movement of water vapor, that is, the movement of latent heat, is inhibited to maintain the heat retaining property, while when the service temperature is high, water vapor is positively passed through the fabric to release latent heat, which prevents occurrence of a sweaty state and a rise in temperature. Therefore, use of the moisture-permeable waterproof fabric of the present invention in wind breakers, ski wear, working clothes, shoes, etc. can provide clothes that have a waterproofing property, exhibit an excellent heat retaining property when the body is not warmed up yet before exercise or in an early stage of exercise, and a high water vapor permeability when the body is in a warmed state during or after exercise, are less likely to cause a sweaty state, can provide a cool feeling, are comfortable and have good hand.

The present invention will now be described in more detail with reference to the following Examples.

In the following Examples, the moisture permeability and water pressure resistance were measured respectively in accordance with JIS L 1099 A-1 and JIS L 1092 (by a low water pressure method for products having a water pressure resistance of 2,000 mmH$_2$O or less and a high water pressure method for products having a water pressure resistance exceeding 2,000 mmH$_2$O).

EXAMPLE 1

A polyester ponzee woven fabric (75D-72F for both warps and wefts, end spacing: 101 yarns/inch, pick spacing: 80 yarns/inch) was subjected to padding with a 10% aqueous solution of Asahi Guard AG710 as a fluoro water repellent, and the padded woven fabric was dried and cured.

A polyol was dissolved in DMF at 50° C. with stirring, and a diisocyanate was placed therein. The mixture was stirred for about one hr to provide a prepolymer. Then, a chain extender was added thereto dropwise to cause a polymerization reaction, thereby providing a DMF solution of 25% by weight of polyurethane resin. MDI as the diisocyanate, polyethylene glycol having a molecular weight of 2,000 and polyethylene glycol adipate diol having a molecular weight of 1,200 each as the polyol and ethylene glycol as the chain extender were mixed together in a molar ratio of 3.4:0.5:0.5:2.5. The glass transition temperature of the resultant polyurethane resin was 0.2° C., and the fraction of ethylene oxide in the polymer was 8.4 mol/kg.

A resin solution prepared by adding 10 parts by weight of DMF and 1 part by weight of Resamine NE (manufactured by Dainichiseika Color & Chemicals) as an isocyanate crosslinking agent to 100 parts by weight of the above-described solution and mixing them with each other was coated on one surface of the above-described woven fabric at a coverage of 15 g/m$^2$, and the coating was solidified in an aqueous solution for 5 min. Thereafter, the solvent was removed with water at 25° C., and the treated woven fabric was washed, dried, subjected to a fluoro oiliness water repellency treatment and then subjected to finish setting at 150° C. to provide a coated woven fabric. The coverage of the polyurethane resin after drying was 5 g/m$^2$. The coated woven fabric thus obtained was subjected to measurement of moisture permeability, water pressure resistance and water vapor permeability ratio (dependency of the moisture permeability upon environment ranging from low-temperature environment to high-temperature environment). The results are given in Table 1.

EXAMPLE 2

A polyester ponzee woven fabric (75D-72F for both warps and wefts, end spacing: 101 yarns/inch, pick spacing: 80 yarns/inch) was subjected to padding with a 10% aqueous solution of Asahi Guard AG 710 as a fluoro water repellent, and the padded woven fabric was dried and cured.

A polyol was dissolved in DMF at 50° C. with stirring, and a diisocyanate was placed therein. The mixture was stirred for about one hr to provide a prepolymer. Then, a chain extender was added thereto dropwise to cause a polymerization reaction, thereby providing a DMF solution of 25% by weight of polyurethane resin. MDI as the diisocyanate, polyethylene glycol having a molecular weight of 2,000 and polyethylene glycol adipate diol having a molecular weight of 1,200 each as the polyol and 1,4-butanediol as the chain extender were mixed together in a molar ratio of 1.2:0.7:0.2:0.2. The glass transition temperature of the resultant polyurethane resin was 3.0° C., and the fraction of ethylene oxide in the polymer was 11.3 mol/kg.

A resin solution prepared by adding 10 parts by weight of DMF and 1 part by weight of Resamine NE (manufactured by Dainichiseika Color & Chemicals) as an isocyanate crosslinking agent to 100 parts by weight of the above-described solution and mixing them with one another was coated on one surface of the above-described woven fabric at a coverage of 15 g/m$^2$, and the coating was solidified in an aqueous solution for 5 min. Thereafter, the solvent was removed with water at 25° C., and the treated woven fabric was washed, dried, subjected to a fluoro oiliness water repellency treatment and then subjected to finish setting at 150° C. to provide a coated woven fabric. The coverage of the polyurethane resin after drying was 5 g/m$^2$. The coated woven fabric thus obtained was subjected to measurement of moisture permeability, water pressure resistance and water vapor permeability ratio (dependency of the moisture permeability upon environment ranging from low-temperature environment to high-temperature environment). The results are given in Table 1.

EXAMPLE 3

A polyester ponzee woven fabric (75D-72F for both warps and wefts, end spacing: 101 yarns/inch, pick spacing: 80 yarns/inch) was subjected to padding with a 10% aqueous solution of Asahi Guard AG710 as a fluoro water repellent, and the padded woven fabric was dried and cured.

A polyol was dissolved in DMF at 50° C. with stirring, and a diisocyanate was placed therein. The mixture was stirred for about one hr to provide a prepolymer. Then, a chain extender was added thereto dropwise to cause a polymerization reaction, thereby providing a DMF solution of 25% by weight of polyurethane resin. MDI as the diisocyanate, polyethylene glycol having a molecular weight of 2,000 and polytetramethylene glycol having a molecular weight of 2,000 each as the polyol and ethylene glycol as the chain extender were mixed together in a molar ratio of 3.3:0.5:0.5:2.4. The glass transition temperature of the resultant polyurethane resin was −8.5° C., and the fraction of ethylene oxide in the polymer was 7.4 mol/kg.

A resin solution prepared by adding 20 parts by weight of methyl ethyl ketone and 80 parts by weight of toluene to 100 parts by weight of the above-described solution and mixing them with one another was coated on a release paper at a coverage of 80 g/m$^2$, and the coating was dried at 120° C. Then, a resin solution prepared by adding 60 parts by weight of toluene and 10 parts by weight of Resamine NE (manufactured by Dainichiseika Color & Chemicals) as an isocyanate crosslinking agent was added to 100 parts by weight of an ether polyurethane resin as a binder resin and mixing them with one another was coated on the resultant resin film and laminated on one surface of the above-described woven fabric. The laminate was aged for 24 hr, and the release paper was peeled off to provide a laminate woven fabric. The coverage of the polyurethane resin after drying was 15 g/m$^2$. The coated woven fabric thus obtained was subjected to measurement of moisture permeability, water pressure resistance and the ratio of water vapor permeability at a high temperature to water vapor permeability at a low temperature. The results are given in Table 1.

EXAMPLE 4

A laminate woven fabric was prepared in the same manner as that of Example 3, except that a polyester knit (a tricot of 30 d and 20 gauge) was used as the woven fabric, and MDI as the diisocyanate, polyethylene glycol having a molecular weight of 2,000 and polytetraethylene glycol having a molecular weight of 2,000 each as the polyol and ethylene glycol as the chain extender were used in a molar ratio of 3.30:0.55:0.45:2.40. The glass transition temperature of the polyurethane resin was −18° C., and the fraction of ethylene oxide in the polymer was 7.8 mol/kg. The laminate woven fabric thus obtained was subjected to measurement of moisture permeability, water pressure resistance and the ratio of water vapor permeability at a high temperature to water vapor permeability at a low temperature. The results are given in Table 1.

EXAMPLE 5

A mixed resin solution having the following composition was coated on one surface of the same woven fabric as that used in Example 4, and the coating was solidified in an aqueous solution for 5 min. Thereafter, the solvent was removed with water at 25° C., and the coating was then dried to provide a woven fabric having a porous film at a coverage of 27 g/m$^2$.

| | |
|---|---|
| Ester polyurethane resin | 100 parts |
| Dimethylformamide | 80 parts |
| Resamine NE (manufactured by Dainichiseika Color & Chemicals) | 1 part |

Then, a woven fabric having a porous film and a nonporous film was prepared using the same resin and method as those of Example 4. The laminate woven fabric thus obtained was subjected to measurement of moisture permeability, water pressure resistance and the ratio of water vapor permeability at a high temperature to water vapor permeability at a low temperature. The results are given in Table 1.

COMPARATIVE EXAMPLE 1

A coated woven fabric was prepared in the same manner as that of Example 2, except that MDI, polyethylene glycol, polyethylene glycol adipate diol and 1,4-butanediol were used in a molar ratio of 3.3:0.3:0.7:2.4. The glass transition temperature of the polyurethane resin was 0.8° C., and the fraction of ethylene oxide in the polymer was 4.54 mol/kg. The coated woven fabric thus obtained was subjected to measurement of moisture permeability, water pressure resistance and the ratio of water vapor permeability at a high temperature to water vapor permeability at a low temperature. The results are given in Table 1.

COMPARATIVE EXAMPLE 2

A coated woven fabric was prepared in the same manner as that of Example 2, except that the polyurethane resin used had a glass transition temperature of −50° C. The coated woven fabric thus obtained was subjected to measurement of moisture permeability, water pressure resistance and the ratio of water vapor permeability at a high temperature to water vapor permeability at a low temperature. The results are given in Table 1.

COMPARATIVE EXAMPLE 3

A coated woven fabric was prepared in the same manner as that of Example 2, except that the polyurethane resin used had a glass transition temperature of −50° C. and a high moisture permeability. The coated woven fabric thus obtained was subjected to measurement of moisture permeability, water pressure resistance and the ratio of water vapor permeability at a high temperature to water vapor permeability at a low temperature. The results are given in Table 1.

COMPARATIVE EXAMPLE 4

A laminate woven fabric was prepared in the same manner as that of Example 4, except that the polyurethane resin used had a glass transition temperature of −50° C. The laminate woven fabric thus obtained was subjected to measurement of moisture permeability, water pressure resistance and the ratio of water vapor permeability at a high temperature to water vapor permeability at a low temperature. The results are given in Table 1.

TABLE 1

| | Glass transition point (Tg:°C.) | Molar fraction of ethylene oxide | Moistuer permeability*1 5° C.*2 | Moistuer permeability*1 40° C.*2 | Water pressure resistance ($mmH_2O$) (early stage) | Water vapor permeability*3 At low temp. (5° C.) | Water vapor permeability*3 At high temp. (40° C.) | Water vapor permeability ratio |
|---|---|---|---|---|---|---|---|---|
| Ex. 1 | 0.2 | 8.4 | 944 | 11232 | 1200 | 156 | 225 | 1.44 |
| Ex. 2 | 3.0 | 11.3 | 1060 | 15432 | 1000 | 200 | 310 | 1.55 |
| Ex. 3 | −8.5 | 7.4 | 525 | 6910 | 12000 | 89 | 139 | 1.56 |
| Ex. 4 | −18 | 7.8 | 624 | 8064 | 15000 | 106 | 162 | 1.53 |
| Ex. 5 | −18 | 7.8 | 508 | 6900 | 25000 | 96 | 138 | 1.43 |
| Comp. Ex.1 | 0.8 | 4.5 | 520 | 6552 | 550 | 88 | 131 | 1.50 |
| Comp. Ex.2: | −50 | — | 648 | 5300 | 2000 | 101 | 106 | 1.04 |
| Comp. Ex.3 | −50 | — | 1190 | 10060 | 1200 | 202 | 200 | 0.99 |
| Comp. Ex.4 | −50 | — | 432 | 3576 | 16000 | 62 | 72 | 1.18 |

Note:
*1unit: ($g/m^2$.24 hr)
*2humidity: 90% RH
*3unit: ($g/m^2$.24 hr.mmHg)

We claim:

1. A moisture-permeable waterproof fabric comprising a textile fabric and, provided on at least one surface of said textile fabric, a resin film comprising a polyurethane resin produced by reacting an isocyanate with a polyol and a chain extender and having a glass transition temperature in the range of from −20° to 20° C. and an ethylene oxide unit content of at least 7.0 mol/kg, wherein the ratio of the water vapor permeability at a high temperature to the water vapor permeability at a low temperature is 1.4 or higher.

2. A moisture-permeable waterproof fabric according to claim 1, wherein said polyol component comprises a mixture comprising polyethylene glycol and polytetramethylene glycol, said polyols having a molecular weight in the range of from 500 to 3,000.

3. A moisture-permeable waterproof fabric according to claim 1, wherein said polyol component comprises a mixture comprising polyethylene glycol and an ester of ethylene oxide with adipic acid, said polyols having a molecular weight in the range of from 500 to 3,000.

4. A moisture-permeable waterproof fabric according to claim 1, wherein said resin film is porous.

5. A moisture-permeable waterproof fabric according to claim 1, wherein said resin film is nonporous.

6. A moisture-permeable waterproof fabric according to claim 1, wherein a heat retaining property of the fabric is inversely proportional to an ambient temperature.

7. A moisture-permeable waterproof fabric according to claim 1, wherein the moisture permeability in a low-temperature environment is less than 1,000 $g/m^2$.24 hr and the moisture permeability in a high-temperature environment is 8,000 $g/m^2$.24 hr or more.

8. A moisture-permeable waterproof fabric consisting of a textile fabric and, provided on at least one surface of said textile fabric, a polyurethane resin film comprising a polyurethane resin produced by reacting an isocyanate with a polyol and a chain extender and having a glass transition temperature in the range of from −20° to 20° C. and an ethylene oxide unit content of at least 7.0 mol/kg, wherein the ratio of the vapor permeability at a high temperature to the water vapor permeability at a low temperature is 1.4 or higher.

9. A moisture-permeable waterproof fabric according to claim 8, wherein said polyol component comprises a mixture comprising polyethylene glycol and polytetramethylene glycol, said polyols having a molecular weight in the range of from 500 to 3,000.

10. A moisture-permeable waterproof fabric according to claim 8, wherein said polyol component comprises a mixture comprising polyethylene glycol and an ester of ethylene oxide with adipic acid, said polyols having a molecular weight in the range of from 500 to 3,000.

11. A moisture-permeable waterproof fabric according to claim 8, wherein said resin film is porous.

12. A moisture-permeable waterproof fabric according to claim 8, wherein said resin film is nonporous.

13. A moisture-permeable waterproof fabric according to claim 8, wherein the moisture permeability in a low-temperature environment is less than 1,000 $g/m^2$.24 hr and the moisture permeability in a high-temperature environment is 8,000 $g/m^2$.24 hr or more.

14. A moisture-permeable waterproof fabric according to claim 8, wherein a heat retaining property of the fabric is inversely proportional to an ambient temperature.

15. A process for producing a moisture-permeable waterproof fabric, comprising the steps of: coating at least one surface of a textile fabric with a solution of a resin in a polar organic solvent, said resin comprising a polyurethane resin produced by reacting an isocyanate with a polyol and a chain extender and having a glass transition temperature in the range of from −20° to 20° C. and an ethylene oxide unit content of at least 7.0 mol/kg, and subjecting the coating to wet solidification in a coagulation bath to form a film.

16. A process for producing a moisture-permeable waterproof fabric, comprising the steps of: coating a release paper with a solution of a resin in a polar organic solvent to form a resin film, said resin comprising a polyurethane resin produced by reacting an isocyanate with a polyol and a chain extender and having a glass transition temperature in the range of from −20° to 20° C. and an ethylene oxide unit content of at least 7.0 mol/kg, and adhering said resin film on at least one surface of a textile fabric.

* * * * *